US009272396B2

(12) United States Patent
Stricker

(10) Patent No.: US 9,272,396 B2
(45) Date of Patent: Mar. 1, 2016

(54) WATER SOFTENER FILTER WRENCH SYSTEM

(76) Inventor: Herbert Stricker, South Lyon, MI (US)

( * ) Notice: Subject to any disclaimer, the term of this patent is extended or adjusted under 35 U.S.C. 154(b) by 153 days.

(21) Appl. No.: 13/330,655

(22) Filed: Dec. 19, 2011

(65) Prior Publication Data

US 2012/0325058 A1 Dec. 27, 2012

Related U.S. Application Data

(60) Provisional application No. 61/457,859, filed on Jun. 22, 2011.

(51) Int. Cl.
*B25B 13/50* (2006.01)
*B25G 1/10* (2006.01)

(52) U.S. Cl.
CPC ..... *B25B 13/50* (2013.01); *B25G 1/105* (2013.01)

(58) Field of Classification Search
CPC ..... B25B 13/48; B25B 13/50; B25G 1/105
USPC ..... 81/176.1, 124.3, 124.4; D8/17, 19
See application file for complete search history.

(56) References Cited

U.S. PATENT DOCUMENTS 1,870,612 A * 8/1932 De Schebeko ..... 81/124.3
D176,005 S * 11/1955 Cariello ..... D8/17
2,801,561 A * 8/1957 Bonner ..... 81/124.3
3,354,757 A * 11/1967 Grimm et al. ..... 81/176.1
3,695,124 A * 10/1972 Myers ..... 81/124.3
3,929,152 A * 12/1975 Graham ..... 137/296
4,532,834 A * 8/1985 Hartman ..... 81/16
D329,788 S * 9/1992 Andrew ..... D8/17
6,098,503 A * 8/2000 Hlinka ..... 81/124.3
D458,523 S * 6/2002 Newton, Sr. ..... D8/17
D461,107 S * 8/2002 Pitt ..... D8/17
6,505,532 B1 * 1/2003 Lawson ..... 81/124.3
6,745,648 B2 * 6/2004 Stier ..... 81/119
6,899,002 B2 * 5/2005 Willis, Sr. ..... 81/177.7
6,938,523 B1 * 9/2005 Farrey ..... 81/124.4
7,670,485 B2 * 3/2010 Duplessis et al. ..... 210/190
2011/0271802 A1 * 11/2011 Honig ..... 81/489
2012/0255399 A1 * 10/2012 Caraballo ..... 81/124.3

* cited by examiner

*Primary Examiner* — David B Thomas

(74) *Attorney, Agent, or Firm* — Kile Park Reed & Houtteman PLLC

(57) ABSTRACT

In general, the invention is a wrench made of a heavy and rust-resistant steel, which is 7-gauge in a preferred embodiment, as well as zinc coated in a primary embodiment, formed to one of the water filter sizes, including but not limited to: SW1, SW2, SW3, SW5-a, 144880 BW-BC, C-shaped (open end) Universal style, S3072, HT-HTF, OW1, OW2, OW6. The handle is at least 1.5 times the head diameter for easy use and the head is fitted with the various water filter sizes. A plastic or rubber cover is used on the handle for grip and for installing directions.

9 Claims, 8 Drawing Sheets

WATER SOFTENER FILTER WRENCH SYSTEM

REFERENCE TO PRIORITY DOCUMENTS

This patent application claims priority under 35 USC §119 (e) to U.S. Provisional Application 61/457,859, filed in the USPTO on Dec. 17, 2010, which is incorporated by reference in its entirety for all purposes.

BACKGROUND

Existing water-softener wrenches are typically made of weak breakable plastic and sold to customers.

REFERENCE TO THE DRAWINGS

FIG. 1A illustrates a first embodiment of the water softener wrench;

FIG. 1B illustrates details of the head of the first embodiment;

FIG. 1C illustrates the first embodiment of the wrench by the side;

FIG. 1D illustrates the details of the neck of the first embodiment;

FIG. 1E illustrates the details of the grip of the first embodiment;

FIG. 2 illustrates an alternate embodiment;

FIG. 3 illustrates a second alternate embodiment; and

FIG. 4 illustrates a variety of wrenches in various embodiments.

DESCRIPTION OF THE DRAWINGS

The invention is not limited to the illustrated embodiments. In general the invention is a wrench made of a heavy and rust-resistant (laser cut in a preferred embodiment) steel, which is 7-gauge in a preferred embodiment, as well as zinc coated in a primary embodiment, formed to one of the water filter sizes, including but not limited to: SW1, SW2, SW3, SW5-a, 144880 BW-BC, C-shaped (open end) Universal style, S3072, HT-HTF, OW1, OW2, OW6. The standards, regarding the dimensions and other features of these wrenches are known in the art, and are incorporated by reference herein. A fuller description of the specific types and manufactures, not meant to be exhaustive, is included here in Appendix I.

Additionally, the inventive wrench is also compatible with different brands such as Culligan, Ametek, US Filter, Plymouth, Keen Plus, American Plumber, Bruner and many other brands. Furthermore, the invention is not limited to a particular size or configuration or brand.

FIG. 1A illustrates a Superb Wrench™ which is a primary embodiment of the invention. As stated above, the invention is made to replace inferior, breakable plastic wrenches, but without a substantial cost to the end consumer, because it is easily manufactured and lasts for a long time. The wrench has a long handle H which is typically between 1.5 and 2 times the diameter of the head HE of the wrench. The handle H include an easily applied and comfortable Grip G, which in the present embodiment is shown as made of a hollow PVC tube which slides over the handle. The handle H also has some indicators formed or cut into it to help the user. These include a designator D, shown by the broken circle, and a label L to help the novice or occasional user to operate the wrench. Alternate embodiments may not keep the feature where the handle is 1.5-2 times the diameter of the head HE. Particularly, where the wrench head is particularly large.

The head HE can be of various specifications, as stated above. The embodiment shown has six openings O1, and is shown to be of the SW-1A type water softener wrench. FIG. 1B illustrates the details of the head of the water softener wrench in a primary embodiment. The manufacturing process of the material of which the wrench is made allows for different features to be implemented on the inside surface IS and the opening surface OS. However, in a primary embodiment the head HE shown is suitable for the use of removing a difficult to dislodge water softener filter.

FIG. 1C illustrates the water softener filter wrench in a first embodiment from a side view. Features of the material used are shown in the illustration, however, such features are dependent on the manufacturing process of the wrench and may be different in an alternate embodiment. FIG. 1D illustrates the features of the "neck" of the water softener filter wrench, or the junction of the handle and head. The label L is shown imprinted into the neck area for easy visibility and understanding as turning the water softener filter the wrong way could cause damage.

FIG. 1E shows that the wrench includes a PVC grip G on the handle, allowing for ease of use and for comfort on the hands. There is a small portion OE of the grip G that allows for easy addition and/or replacement and is generally easy to grip and also allows for thermal protect of the hands away from a very cold (or very hot) steel wrench. Although shown in black, there may be variations of the PVC grip G as may be aesthetically pleasing or even a coding system. Like PVC there also may be useful printing on the grip sleeve G.

APPENDIX I

Figure 1A:
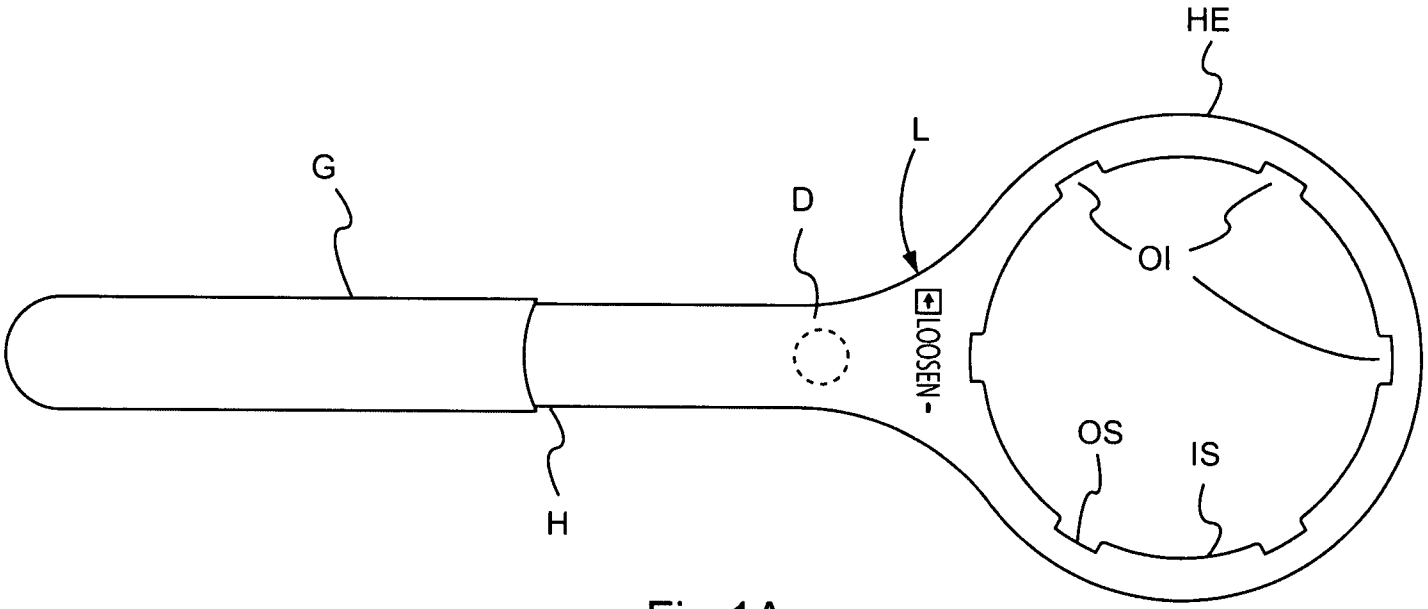
FIGS. 1A-E shows a primary embodiment, a style of wrench, made of rust-resistant steel. The weight and sturdiness of the material allow for ease of use and durability for long-term storage, which makes the wrench appropriate for both intermittent at-home use and for the professional.
Figure 1B:
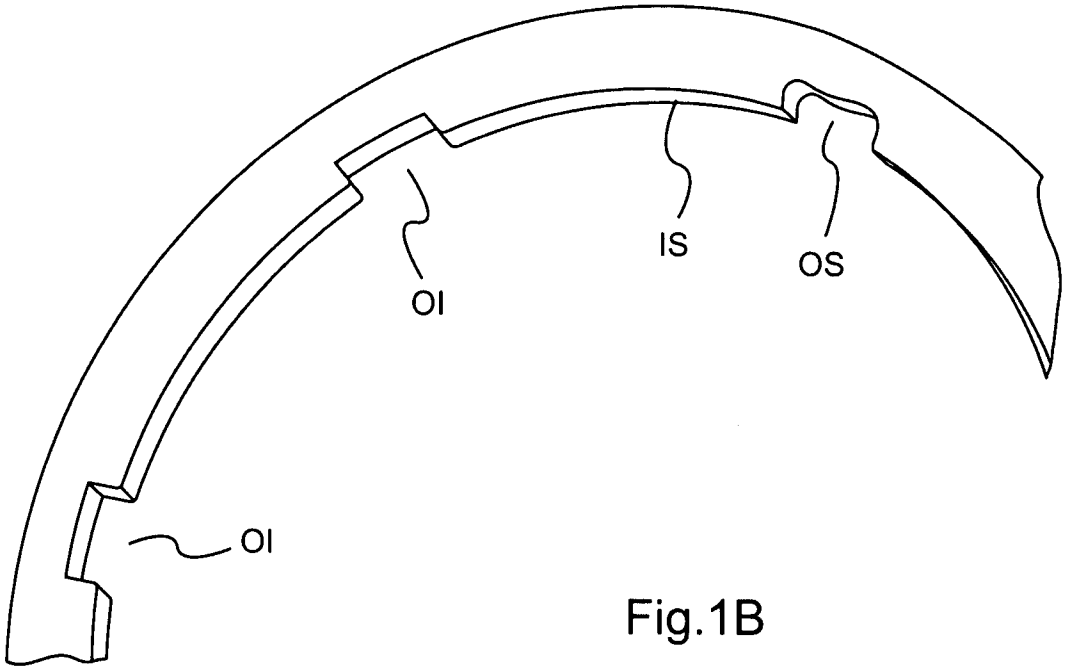
Figure 1C:
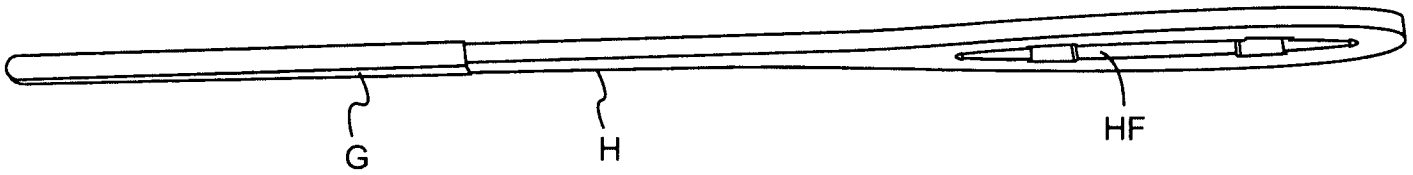
Figure 1D:
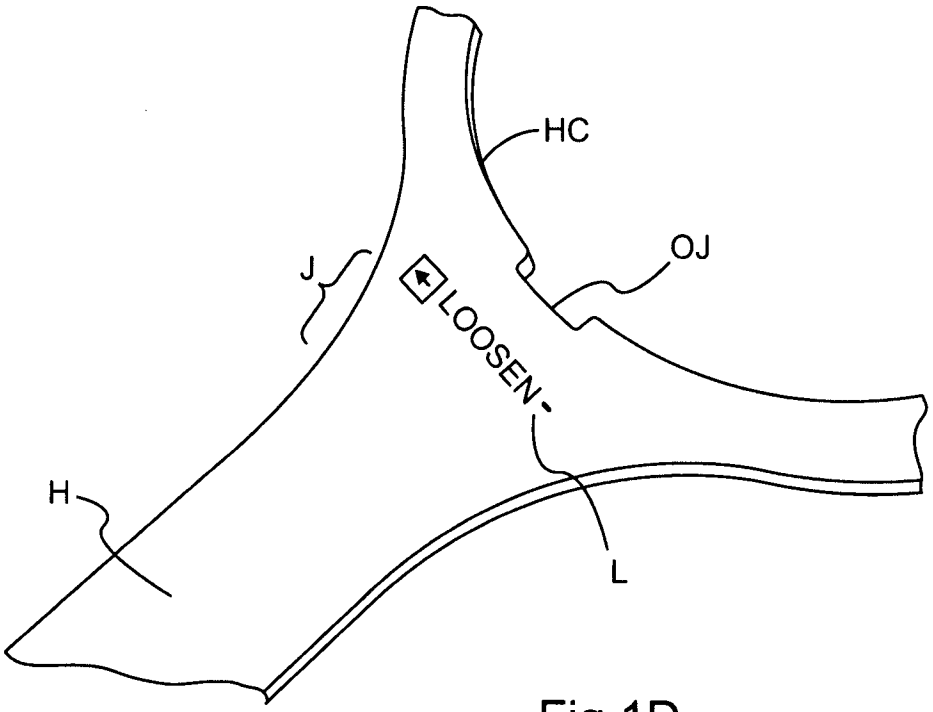
Figure 1E:
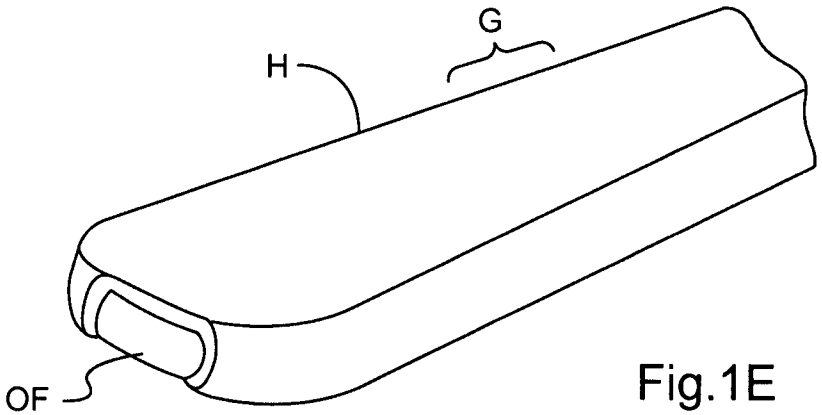
Figure 2:
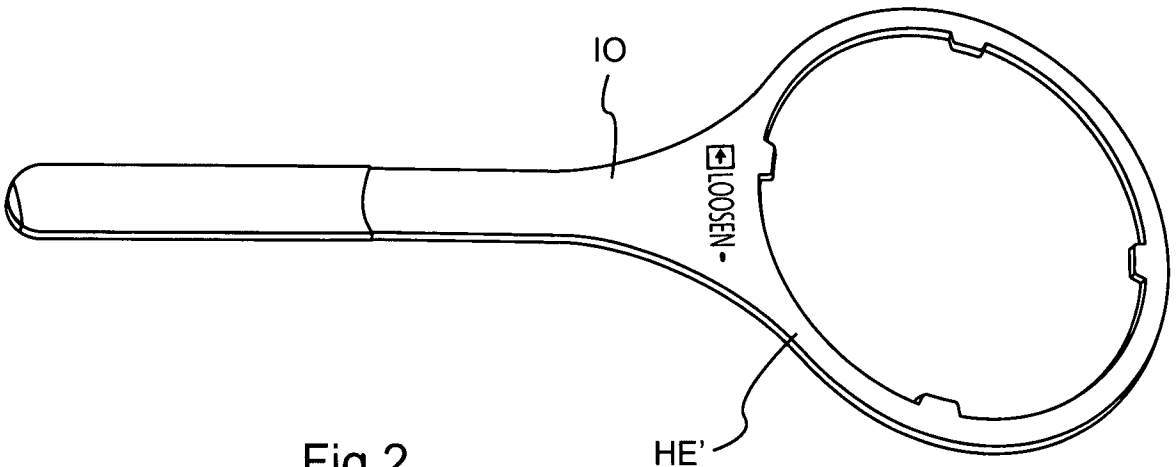
FIG. 2 illustrates the water softener filter wrench in an alternate embodiment. The alternate embodiment (shown as Superb Wrench™ No. 3) is a different water softener filter standard SW2 in the wrench head HE'. Most of the features of the alternate embodiment are similar to those described above for FIGS. 1A-1E, with the exception of the wrench head.
Figure 3:
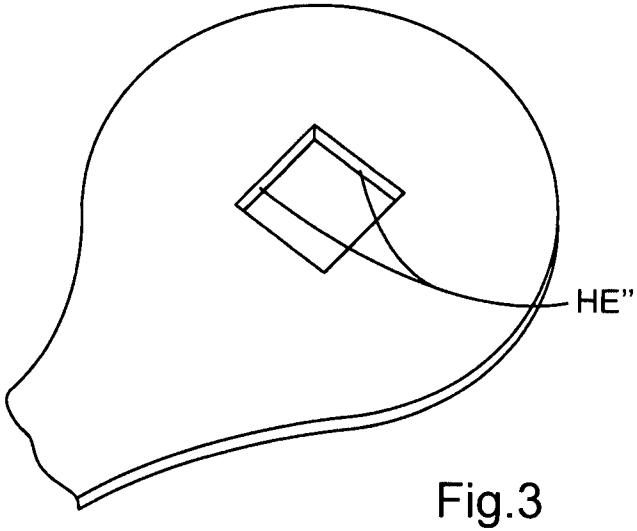
FIG. 3 illustrates a second alternate embodiment (shown as Superb Wrench™ No. 7), and, once again, has similar features to the wrenches shown in FIGS. 1A-2. The second alternate embodiment has a small square aperture in the wrench head HE" and is used on the appropriate water softener filter. The wrench head HE" of the second alternate embodiment is much small proportionally than the wrenches shown above.
Figure 4:
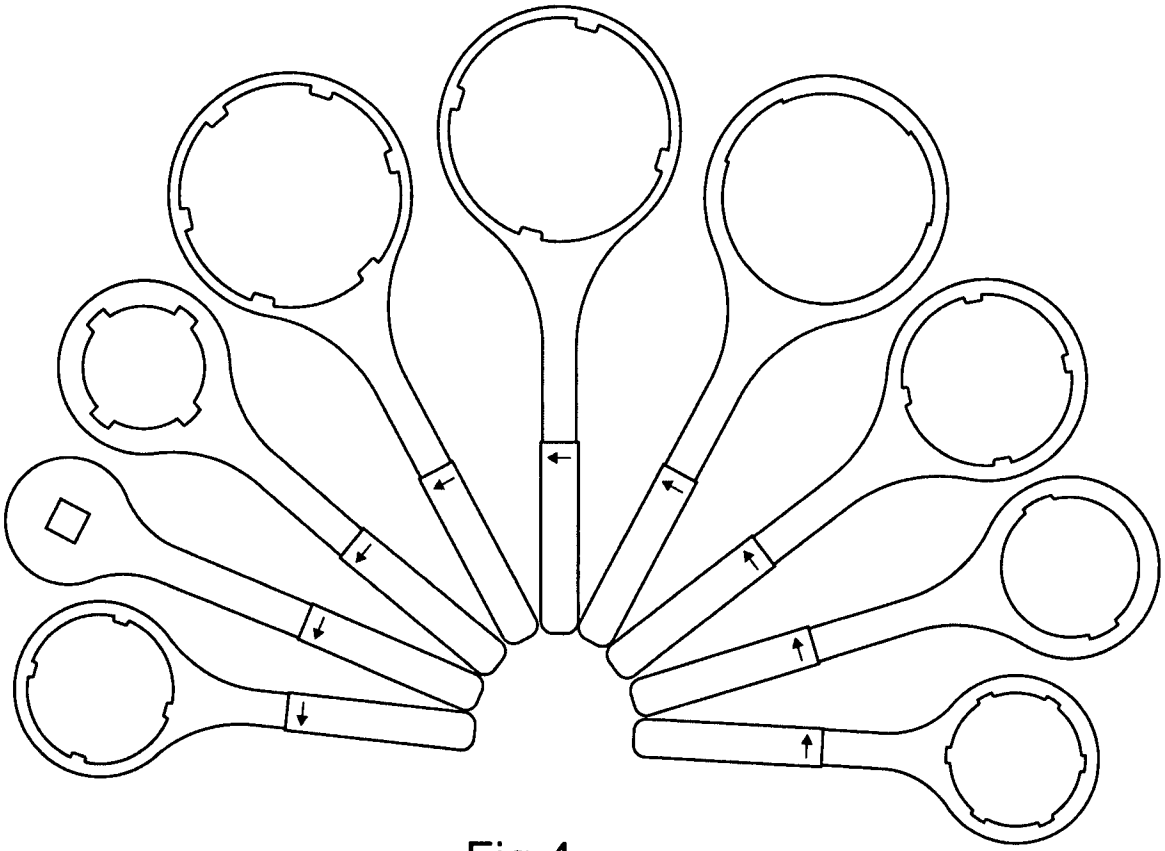
FIG. 4 illustrates a variety of embodiments of the wrench for various standards and manufactures of water filters. The various wrench fitting are described herein, but limited to those listed. The filter fitting means are described further in Appendix I below.

| | Housings | Inside Diameter |
|---|---|---|
| #1 Wrench | Fits most Ametek, Ametek, US Filter, Culligan, Crystal Quest, Plymouth, Keen Plus, American Plumber, Bruner & many more, 10 × 2.5, Culligan RF-150, HF-160, HF-360, HF-365 | 4¾" |

APPENDIX I-continued

| | Housings | Inside Diameter |
|---|---|---|
| #2 Wrench | Fits most Ametek, Ametek, US Filter, Culligan, Crystal Quest, Plymouth, Keen Plus, American Plumber, Bruner & many more. AP800, Big Blue | 6¼" |
| #3 Wrench | Fits most Ametek, Ametek, US Filter, Culligan, Crystal Quest, Plymouth, Keen Plus, American Plumber, Bruner & many more. | 4¼" |
| #4 Wrench | Fits most Ametek, Ametek, US Filter, Culligan, Crystal Quest, Plymouth, Keen Plus, American Plumber, Bruner & many more. | 3¾" |
| #5 Wrench | Fits most Ametek, Ametek, US Filter, Culligan, Crystal Quest, Plymouth, Keen Plus, American Plumber, Bruner & many more. Big Blue 10 × 4.5, 20 × 4.5 can be used with #20 Big Blue, Culligan Pentek HD-950, Ace Hardware 49561, Ametek Kleen-Plus HD-10-R50 BBS, American Plumber W15-PR/152016, Pentek 150237, 150239, 150469 | 5¾" |
| #6 Wrench | Fits most Ametek, Ametek, US Filter, Culligan, Crystal Quest, Plymouth, Keen Plus, American Plumber, Bruner & many more. AP101, AP102, AP12 | 3¾" |
| #7 Wrench | Metal filter wrench for AP200 under the sink system | .935 × .935 |
| #8 Wrench | Fits most Ametek, Ametek, US Filter, Culligan, Crystal Quest, Plymouth, Keen Plus, American Plumber, Bruner & many more. Big Blue 10 × 4.5, 20 × 4.5 can be used with #20 Big Blue, Culligan Pentek HD-950, Ace Hardware 49561, Ametek Kleen-Plus HD-10-R50 BBS, American Plumber W15-PR/152016, Pentek 150237, 150239, 150469 | 6" |
| #9 Wrench | Fits most Ametek, Ametek, US Filter, Culligan, Crystal Quest, Plymouth, Keen Plus, American Plumber, Bruner & many more, AP1610SS, AP2610SS, SSTI, SSTIHA, SST2HB | 3½" |

I claim:

1. A wrench specifically fashioned to fit a water softener filter, made of metal, said wrench including a handle portion connected to a circular head portion, said circular head portion including a circular outside portion and a filter gripping feature on an inside portion of said circular head portion; said handle portion a first width at a gripping end, and said handle portion expanding from said first width to a second width at said connection to said circular head portion, wherein an inside diameter of said circular head portion is selected from within a range of from approximately 3.5 to approximately 6.25 inches, and wherein a length of said handle portion is between 1.5 and 2 times an outside diameter of said circular head portion.

2. The wrench as recited in claim 1, wherein said metal is steel.

3. The wrench as recited in claim 2, wherein said steel is laser-cut.

4. The wrench as recited in claim 1, which includes a direction arrow, said direction arrow assisting in operation of said wrench.

5. The wrench as recited in claim 1, wherein a rubberized grip covers a portion of said handle from the gripping end of said handle towards said circular head portion.

6. A wrench specifically fashioned to fit a water softener filter, made of metal, said wrench including a handle portion connected to a head portion, said head portion including a filter gripping feature on an inside portion of said head portion; said head portion a first width at a gripping end, and said handle portion expanding from said width to a second width at said connection to said head portion a rubberized grip covering said handle a portion of the way from the end of said handle towards said head portion, characterized in that the inside dimension of the said head portion is 0.935 cm×0.935 cm in a square configuration.

7. The wrench as recited in claim 6, wherein said metal is steel.

8. The wrench as recited in claim 7, wherein the steel is laser cut.

9. The wrench as recited in claim 6, which includes a direction arrow, said direction arrow assisting in operation of said wrench.

* * * * *